US005652478A

United States Patent [19]

Sakai et al.

[11] Patent Number: 5,652,478

[45] Date of Patent: Jul. 29, 1997

[54] GASEOUS DISCHARGE DISPLAY

[75] Inventors: Tetsuo Sakai, Tokyo; Keiji Ishii; Mizumoto Ushirozawa, both of Kanagawa; Yoshimichi Takano, Tokyo; Yukio Murakami, Kanagawa; Yasushi Motoyama, Tokyo; Kazuo Takahashi, Osaka, all of Japan

[73] Assignees: Matsushita Electronics Corporation, Osaka; Nippon Hoso Kyokai, Tokyo, both of Japan

[21] Appl. No.: 721,975

[22] Filed: Sep. 27, 1996

Related U.S. Application Data

[63] Continuation of Ser. No. 373,786, Jan. 17, 1995, abandoned.

[30] Foreign Application Priority Data

Jan. 17, 1994 [JP] Japan ..... 6-002978

[51] Int. Cl.[6] ..... H05B 37/02

[52] U.S. Cl. ..... 315/169.4; 315/56; 313/484

[58] Field of Search ..... 315/169.4, 56, 315/71, 58; 313/484, 220

[56] References Cited

U.S. PATENT DOCUMENTS 4,060,749 11/1977 Shinada et al. ..... 315/58
4,780,644 10/1988 Sakai et al. ..... 315/169.4

FOREIGN PATENT DOCUMENTS 5-119740 5/1993 Japan .
6-12988 1/1994 Japan .

*Primary Examiner*—Robert Pascal
*Assistant Examiner*—Michael Shingleton
*Attorney, Agent, or Firm*—McDermott, Will & Emery

[57] ABSTRACT

A display anode connected to a display anode bus bar and a display cathode connected to a cathode bus bar cooperatively constitute a display cell. An auxiliary anode connected to an auxiliary anode bus bar and an auxiliary cathode connected to an auxiliary cathode bus bar cooperatively constitute an auxiliary cell. Each of the display anode is connected in series with a display anode resistance. Each of the auxiliary anode is connected in series with an auxiliary anode resistance.

4 Claims, 10 Drawing Sheets

GASEOUS DISCHARGE DISPLAY

This is a continuation of application Ser. No. 08/373,786 filed Jan. 17, 1995, now abandoned.

BACKGROUND OF THE INVENTION

The present invention relates to a gaseous discharge display.

There have been some conventional gaseous discharge display devices of direct current type having an auxiliary discharge mechanism. FIG. 7 is the one having no resistance connected to each display cell, while FIG. 8 is the one having resistances connected to corresponding display cells in series.

In FIGS. 7 and 8, a reference numeral 10 represents a front plate, a reference numeral 12 represents a rear plate. The front plate 10 is provided with a black matrix 14. The rear plate 12 is provided with a white back 16 of an isolating layer, and a phosphor 18. A partition wall or barrier 20 separates a space between the front plate 10 and the rear plate 12 into numerous cells. Furthermore, in the drawings, a reference numeral 22 represents a display anode bus bar, a reference numeral 24 represents a display anode, a reference numeral 26 represents an auxiliary anode bus bar, a reference numeral 28 represents an auxiliary anode, a reference numeral 30 represents a cathode bus bar, a reference numeral 31 represents a display cathode, and a reference numeral 32 represents an auxiliary cathode. The display anode 24 and the display cathode 31 cooperatively constitute a display cell 34. The auxiliary anode 28 and the auxiliary cathode 32 cooperatively constitute an auxiliary cell 36. The partition wall 20 is provided with a priming slit 38 which guides an exited particles generated by the auxiliary cell 36 to the display cell 34.

In FIG. 8, a reference numeral 40 represents a display electrode resistance provided on a corresponding display electrode 24. The resistance equipped, gaseous discharge display shown in FIG. 8 realizes the pulse memory driving of the display cell 34 using a constant-voltage source. If the gas pressure is increased to elongate the life of the gaseous discharge display, the V-I characteristics of a cell of the gaseous discharge display will be flattened. Thus, the writing operation is impossible when the display electrode resistance 40 is omitted.

The auxiliary cell 36 acts to quickly build up the writing discharge in a display cell 34 within a short time of approximately 1 μs. The auxiliary cell 36 causes a discharge occurring simultaneously with the writing pulse. FIG. 9 is a view showing a fundamental arrangement of the resistance equipped, gaseous discharge display shown in FIG. 8. This resistance-equipped gaseous discharge display is applied pulses having waveforms shown in FIG. 10 according to the pulse memory driving method. In FIG. 9, a reference numeral 43 represents a memory panel of this resistance-equipped gaseous discharge display. In the waveforms shown in FIG. 10, a sustaining pulse has a period T of 4 μs and a width $\tau_{sp}$ of 1 μs; a writing pulse has a width $\tau_w$ of 2 82 s; and a cathode scan pulse has a width $\tau_k$ of 2–3 μs. In such a resistance-equipped gaseous discharge display, the auxiliary cell 36 is usually driven by a constant-current source. An auxiliary anode bus bar resistance 42 shown in FIG. 9 can act as such a constant-current source.

In the arrangement of FIG. 8, one auxiliary cell 36 is provided for each of two display cells 34, 34. On the other hand, the arrangement of FIG. 9 is different from the that of FIG. 8 in that one auxiliary cell 36 corresponds to only one display cell 34, although the operational function is essentially the same.

As explained previously, the auxiliary cell 36 is driven by a constant-current source in the resistance-equipped gaseous discharge display. For a large scale gaseous discharge display, the electrostatic capacitance between the auxiliary anode 28 and the cathode 32 becomes fairly large. For example, the capacitance of a display having a height of 600 mm will be in a level of approximately of 60 pF. The auxiliary cell 36 is generally equipped with no barrier to be provided between cells; therefore, a small voltage difference of 5–10 V will be caused between the discharge ignition voltage and the maintaining voltage corresponding to a large discharge current.

In a discharge of the next line, it is necessary to increase the discharge ignition voltage by an amount equal to the above voltage difference. In this case, current I is defined by $I=C\cdot\Delta V/\Delta t$. In the case of C=60 pF, ΔV=10 V and Δt=2 μs, the current I is obtained as I=300 μA. When the auxiliary cell 36 is discharged, electric charges flow also from this capacitance C. Accordingly, an approximately twice large discharge current of 600 μA flows through the auxiliary cell 36.

For this reason, the above-described conventional gaseous discharge display is encountered with the following problems:

(1) Large spattering occurs in the auxiliary cell due to a large discharge current flowing through the auxiliary cell; thus, operation of the auxiliary cell is unstabilized and the life of the auxiliary cell is shortened.

(2) Electric power consumption of the auxiliary cell is increased; thus, an overall efficiency of the gaseous discharge display is reduced.

(3) A large current flows through a driving circuit of the auxiliary cell, such as a cathode driving circuit; accordingly, a large power driving IC is required.

(4) A high pressure value obtainable for the gas filled in the cell is limited; hence, the life of the gaseous discharge display obtained will be unsatisfactory. And, (5) An amount of the priming discharge is so increased that the erroneous discharge may be induced in the non-writing cell. Therefore, it is necessarily required to precisely design the size of the priming slit which guides the priming discharge.

Furthermore, there is the possibility of unstabilizing the operation of the auxiliary cell in the case of the memory driving of display cell. This is because the auxiliary anode constituting the auxiliary cell is subjected to the sustaining pulse for the memory driving of the display cell which is added through a stray capacitance.

SUMMARY OF THE INVENTION

Accordingly, in view of above-described problems encountered in the prior art, a principal object of the present invention is to provide a gaseous discharge display capable of reducing spattering in the auxiliary cells, reducing electric power consumption in the auxiliary cells, reducing the size of the IC required for driving the auxiliary cells, increasing the gas pressure of the filling gas, adequately controlling the priming discharge amount, and eliminating induction of pulses raised from the display anode constituting the display cell, thereby stabilizing the operation of the auxiliary cells in the memory driving of the display cells.

In order to accomplish this and other related objects, the present invention provides an auxiliary cell resistance connected in series to each auxiliary cell, to limit the discharge current flowing through each auxiliary cell.

More specifically, the present invention provides a gaseous discharge display comprising: a plurality of display cells for causing display discharge; a plurality of auxiliary cells, provided so as to correspond to the display cells, for causing priming discharge acting as starter for the display discharge of the display cells; and a plurality of auxiliary cell resistances, each being connected in series with a corresponding one of the auxiliary cell.

According to the gaseous discharge display in accordance with the present invention, the auxiliary cell resistance is connected in series with each of the auxiliary cell. Thus, the anode bus bar or the cathode bus bar causing auxiliary discharge in each auxiliary cell is driven by a constant-voltage source, and the discharge current flowing through each auxiliary cell is limited by the auxiliary cell resistance. Accordingly, a current value of the auxiliary current can be reduced, bringing the following effects:

(1) Spattering occurring in the auxiliary cell is fairly reduced; thus, not only the operation of the auxiliary cell is stabilized but the life of the auxiliary cell is extendable.

(2) Electric power consumption of the auxiliary cell is also reduced; thus, the overall efficiency of the gaseous discharge display is increased.

(3) The size of the driver IC for driving the auxiliary cell can be small.

(4) The pressure value obtainable for the filling gas is sufficiently high; hence, the life of the gaseous discharge display is satisfactorily extended.

(5) The amount of the priming discharge can be optimized; therefore, restrictions imposed on the design of the priming slit can be moderated. Thus, manufacturing yield of the gaseous discharge display can be improved.

Furthermore, as the anode bus bar or the cathode bus bar causing auxiliary discharge in each auxiliary cell is driven by a constant-voltage source, induction of pulses can be prevented from being raised from the display anode constituting the display cell even in the memory driving of the display cell, thereby stabilizing the operation of the auxiliary cells.

In the above gaseous discharge display, it is preferable to further comprise a plurality of display cell resistances, each being connected in series with a corresponding one of the display cells.

Moreover, it is preferable that each of the display cells is driven by memory mode.

Furthermore, it is preferable in the above gaseous discharge display that the plural display cells and the plural auxiliary cells are filled with noble gas including more than 5% Xe or Kr at a pressure not less than 200 Torr.

BRIEF DESCRIPTION OF THE DRAWINGS

The above and other objects, features and advantages of the present invention will become more apparent from the following detailed description which is to be read in conjunction with the accompanying drawings, in which:

FIGS. 2A–2D show details of the auxiliary anode side of the gaseous discharge display in accordance with the above embodiment of the present invention, wherein FIG. 2A is a plane view; FIG. 2B is a cross-sectional view taken along a line Y–Y' of FIG. 2A; FIG. 2C is a cross-sectional view taken along a line X1–X1' of FIG. 2A; and FIG. 2D is a cross-sectional view taken along a line X2–X2' of FIG. 2A;

FIGS. 3A–3D show details of the auxiliary anode side of a gaseous discharge display in accordance with a first modification of the above one embodiment of the present invention, wherein FIG. 3A is a plane view; FIG. 3B is a cross-sectional view taken along a line Y–Y' of FIG. 3A; FIG. 3C is a cross-sectional view taken along a line X1–X1' of FIG. 3A; and FIG. 3D is a cross-sectional view taken along a line X2–X2' of FIG. 3A;

DETAILED DESCRIPTION OF THE PREFERRED EMBODIMENTS

Hereinafter, preferred embodiments of the present invention will be explained in greater detail with reference to the accompanying drawings.

Figure 1:
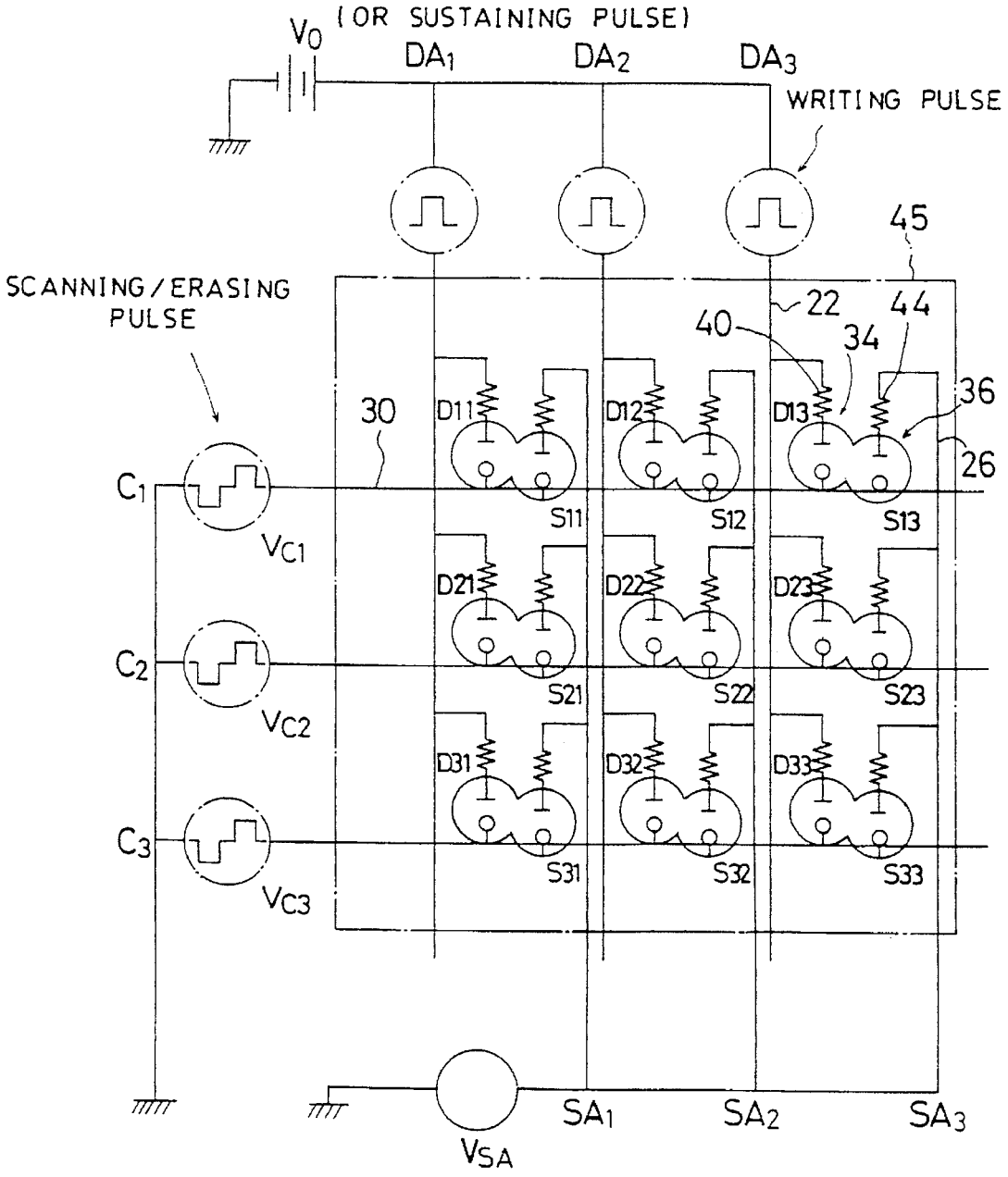
FIG. 1 is a view showing a fundamental arrangement of a gaseous discharge display in accordance with one embodiment of the present invention.
Figure 9:
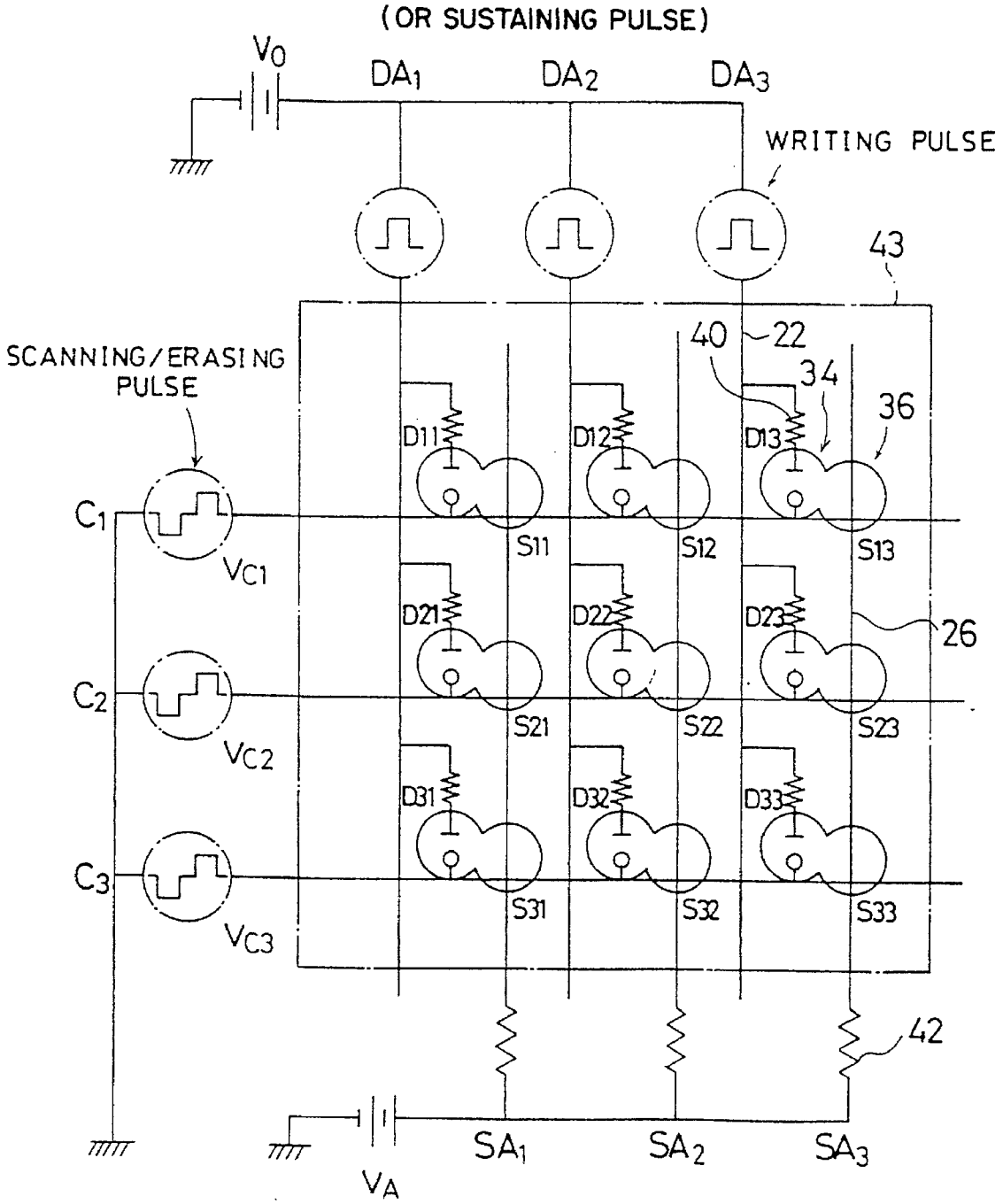
FIG.9 PRIOR ART
FIG. 9 is a view showing a fundamental arrangement of a conventional gaseous discharge display.

FIG. 1 is a view showing a fundamental arrangement of a gaseous discharge display in accordance with one embodiment of the present invention. The gaseous discharge display has the same components as the front plate, the rear plate, the black matrix, the white back, the phosphor, the barrier, the display anode bus bar 22, the display anode, the auxiliary anode bus bar 26, the auxiliary anode, the cathode bus bar 30, the display cathode, the auxiliary cathode, the display cell 34, the auxiliary cell 36, the priming slit and the display anode resistance 40 of the conventional gaseous discharge display of FIG. 9. In FIG. 1, a reference numeral 45 represents a memory panel of the gaseous discharge display in accordance with the present invention.

The arrangement of this embodiment is characterized in that there are provided auxiliary anode resistances 44—44, each being connected in series to the corresponding auxiliary anode constituting the auxiliary cell 36.

Although each display anode resistance 40 is connected to its corresponding display anode and each auxiliary anode resistance 44 is connected to its corresponding auxiliary anode in this embodiment, it is possible to connect at least either of the display anode resistance 40 and the auxiliary anode resistance 44 to the cathode side.

Due to existence of the auxiliary anode resistance 44 connected in series to its corresponding auxiliary anode, this embodiment allows the auxiliary anode bus bar 26 to be driven by a constant-voltage source. The constant voltage is applied as a pulse which is in synchronizing with the auxiliary discharge. The discharge current of each auxiliary cell 36 is limited by the auxiliary anode resistance 44.

FIGS. 2A–2D show details of the auxiliary anode side of the panel arrangement of this embodiment. As shown in FIGS. 2A–2D, the auxiliary anode bus bar 26 is formed on the rear plate 12. The priming slit 38 is formed on the barrier 20. The auxiliary anode bus bar 26 is completely covered by a lower insulating layer 46. The lower insulating layer 46 is formed with a plurality of openings 48 adequately located thereon. A resistance layer 50 is formed on the lower insulating layer 46, so that the resistance layer 50 is connected with the auxiliary anode bus bar 26 via the opening 48. The resistance layer 50 is covered by an upper insulating layer 52 except the region of the auxiliary anode 28.

In this embodiment, the material constituting the auxiliary anode 28 is different from that of the resistance layer 50. For example, the auxiliary anode 28 can be made of Ag. However, it will be alternatively preferable that the auxiliary anode 28 is made of the same material as that of the resistance layer 50 and integrally formed with the resistance layer 50. The cathode bus bar and the cathode are provided on the front plate in the same manner as the conventional arrangement of FIG. 9. However, each of these cathode bus bar and the cathode can be straight in their configuration instead of the disclosed shape.

Figure 2A:
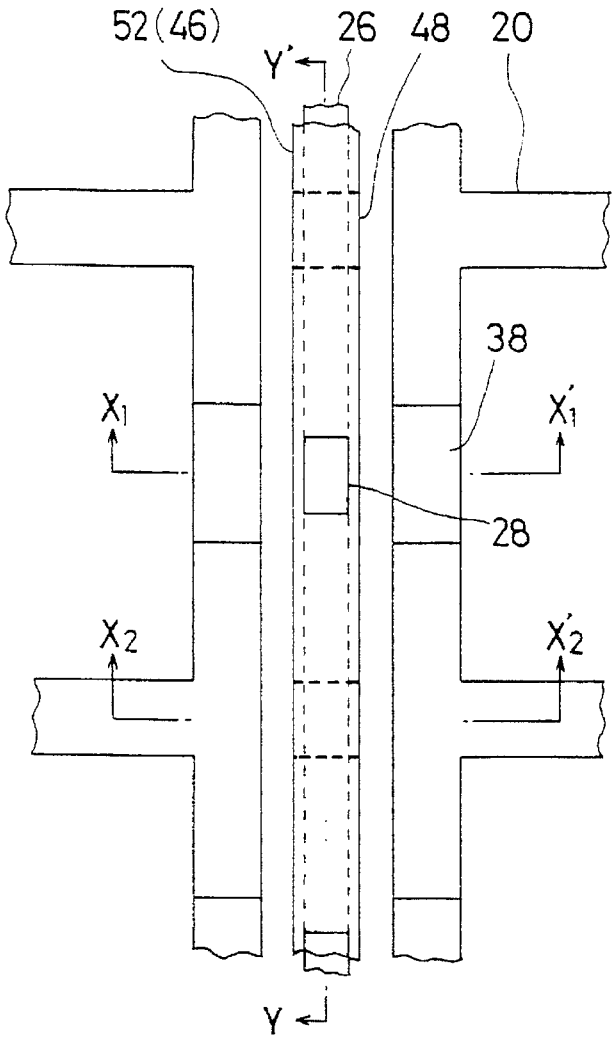
Figure 2B:
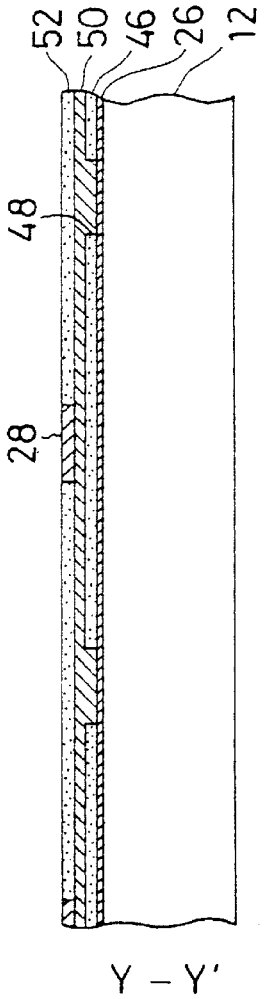
Figure 2C:
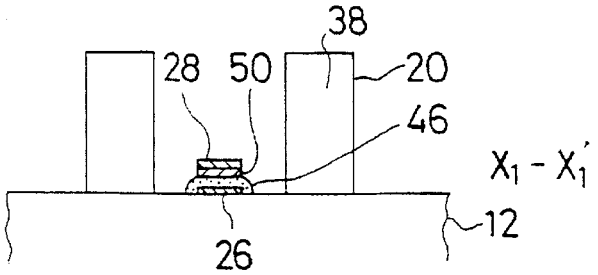
Figure 2D:
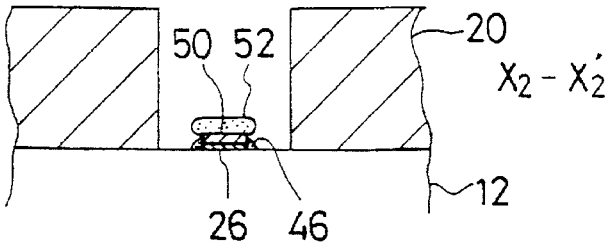
Figure 3A:
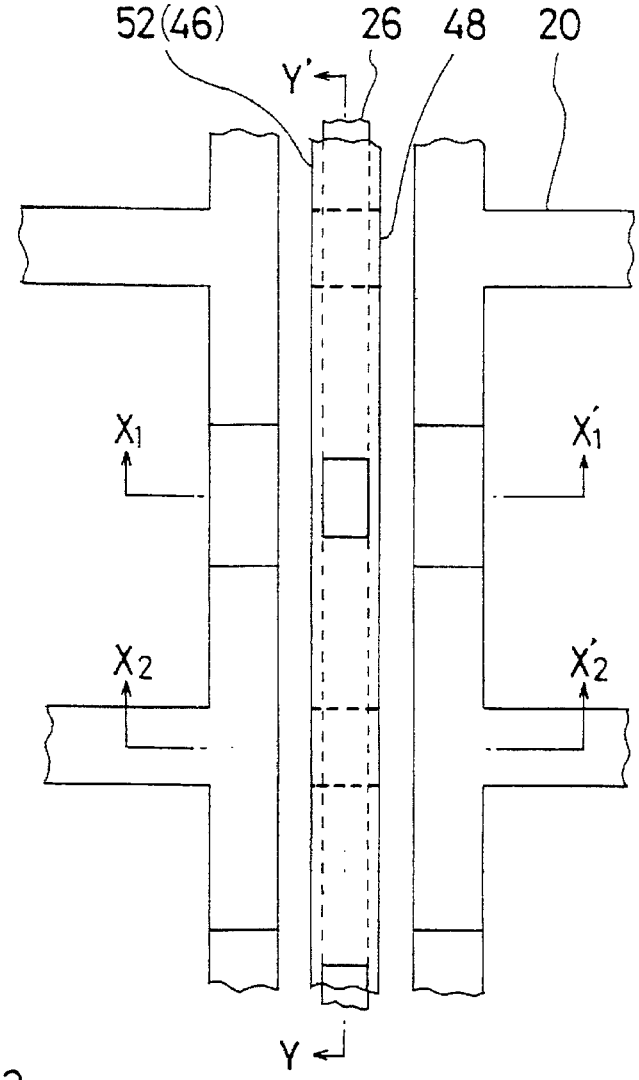
Figure 3B:
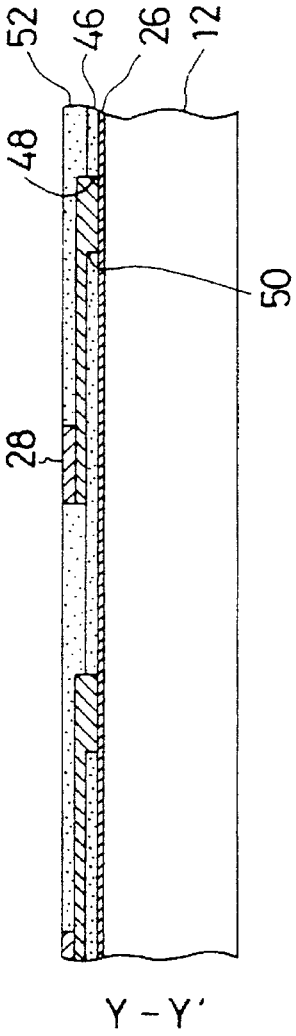
Figure 3C:
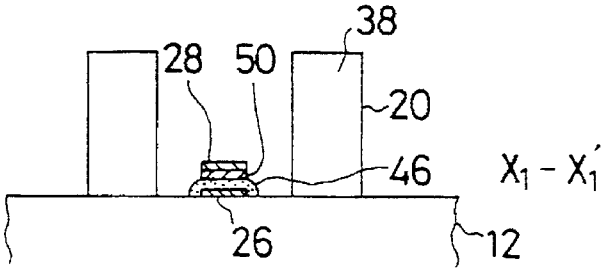
Figure 3D:
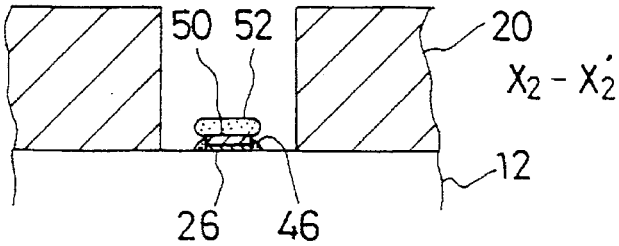

The configuration of the resistance layer 50 shown in FIG. 2B, which is continuous straight configuration, is advantageous in facilitating the printing step. However, the configuration of the resistance layer 50 is not limited to the one disclosed in FIG. 2B. For example, it can be replaced by the split configuration shown in FIG. 3B. Although not shown, the resistance layer 50 can be the one not being piled up on the auxiliary anode bus bar 26, for example, 40 in FIG. 8 or the one having been printed thickly so as to have a sufficiently large resistance value. $RuO_2$ would be a preferable material for forming the resistance layer 50. A thin film of $SnO_2$ would be also preferable.

Various technologies such as thick film printing, sintering, deposition, spattering, and photo-lithography are used to manufacture each part of the gaseous discharge display. Specifically, a combination of the thick film printing of Au, Ag, Al, Cu, Ni or the like and the photo-lithography would be desirable to form the auxiliary anode bus bar 26 into a thin shape. Ordinary glass paste would be preferable for forming the lower insulating layer 46 and the upper insulating layer 52, although deposition or spattering is acceptable too.

In this embodiment, a plurality of auxiliary anode bus bars 26—26, each constituting a row, are connected together and integrated into one at the outside of the panel, and are driven by the constant-voltage source. Alternatively, it is also possible to integrate the auxiliary anode bus bars 26—26 into one before they are extracted out of the panel. The pattern of integrating the auxiliary anode bus bars 26—26 would be flexibly determined. For example, they are divided into some blocks, or separated into one group consisting of even rows and the other group consisting of odd rows. It will be preferable to provide a plurality of driving power sources and independently adjust the voltage of each driving power source, regardless of integration pattern of the auxiliary anode bus bars 26—26.

Figure 4:
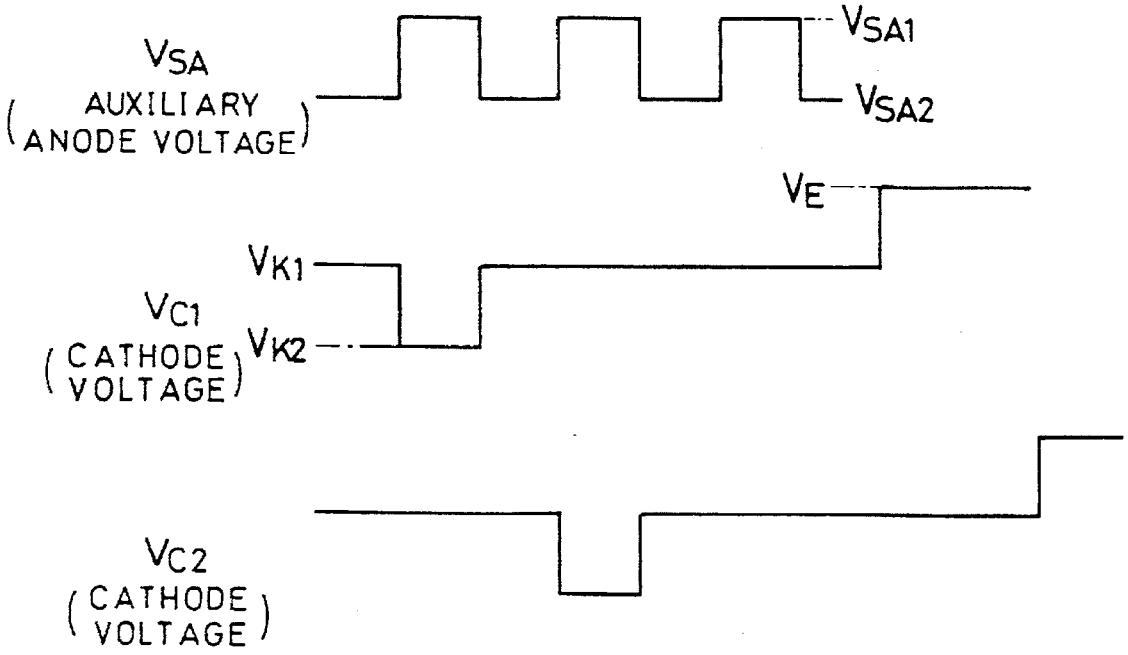
FIG. 4 is a view showing voltage waveforms for driving the gaseous discharge display in accordance with the above one embodiment of the present invention.

FIG. 4 is a view showing voltage waveforms for driving the gaseous discharge display. When the discharge ignition voltage of the auxiliary cell is $V_F$ and the maintenance voltage is $V_S$, it is necessary to satisfy the following relation.

$$V_{SA1}-V_{K2}>V_F,\ V_{SA1}-V_{K1}<V_F,\ V_{SA2}-V_{K1}<V_S$$

When the filling gas used in this embodiment is He-Xe: 10%, 350 Torr, and the cathode material is Al, the discharge ignition voltage $V_F$ and the maintaining voltage $V_S$ are obtained as $V_F$=250 V and $V_S$=210 V. For $V_{SA1}$=100 v, $V_{SA2}$=50 V, $V_{K1}$=−130 V, $V_{K2}$=−200 V, the values of left sides of above inequalities are obtained as $V_{SA1}-V_{K2}$=300 V, $V_{SA1}-V_{K1}$=230 V, $V_{SA2}-C_{K1}$=180 V which satisfy the above inequalities. A preferable value of $V_E$ would be in a range of 0 to −100 v.

Figure 10:
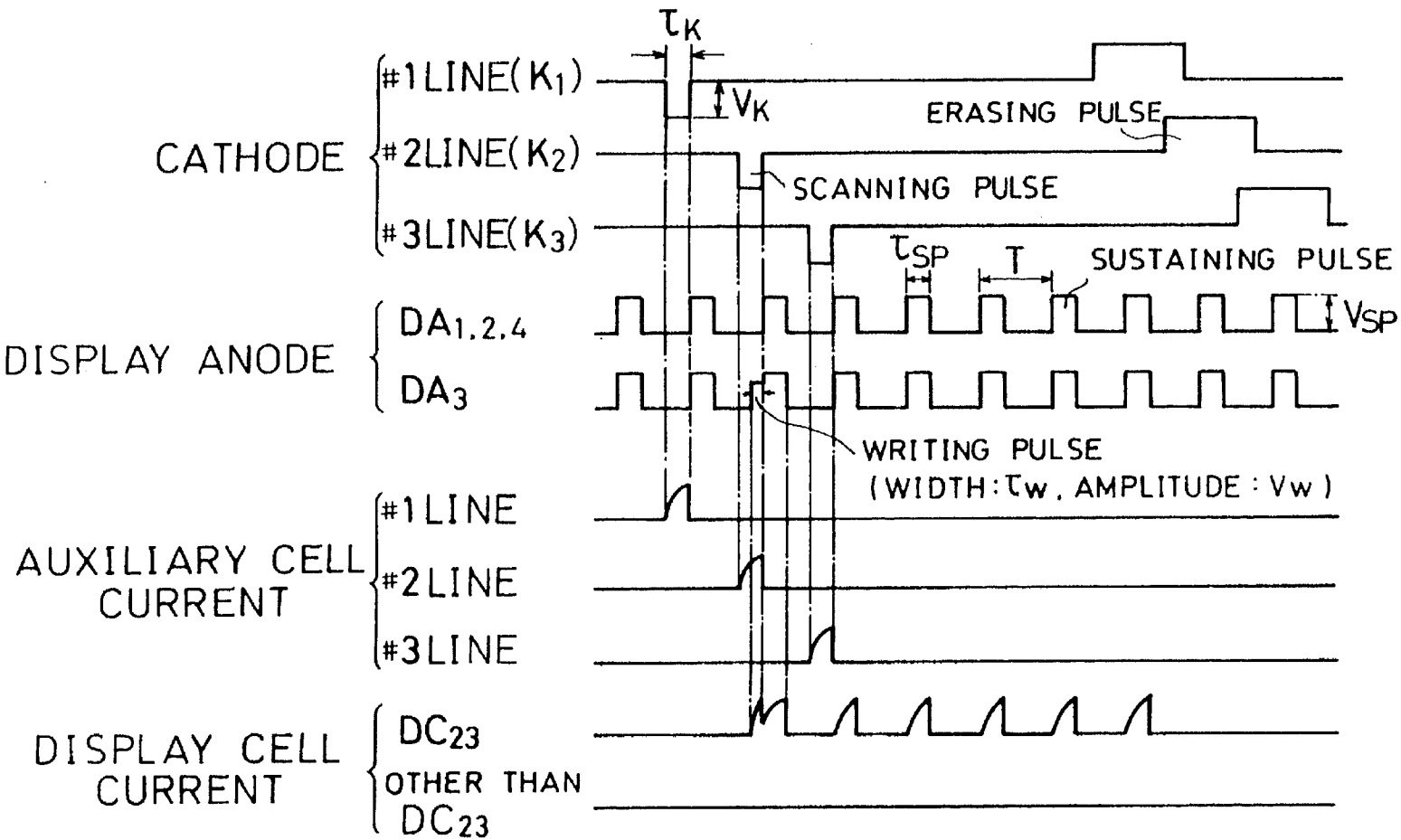
FIG. 10 is a time chart illustrating driving of the pulse memory in accordance with the above one embodiment of the present invention and prior art.

A driving method similar to the conventional method explained with reference to FIG. 10 would be adopted in this embodiment. However, other methods would be also applicable. For example, the present invention can be applied to the pulse memory driving method or the direct current mode disclosed in Unexamined Japanese Patent Application No. HEI 5-119740/1993 and Unexamined Japanese Patent Application No. HEI 4-169283/1992.

Figure 7:
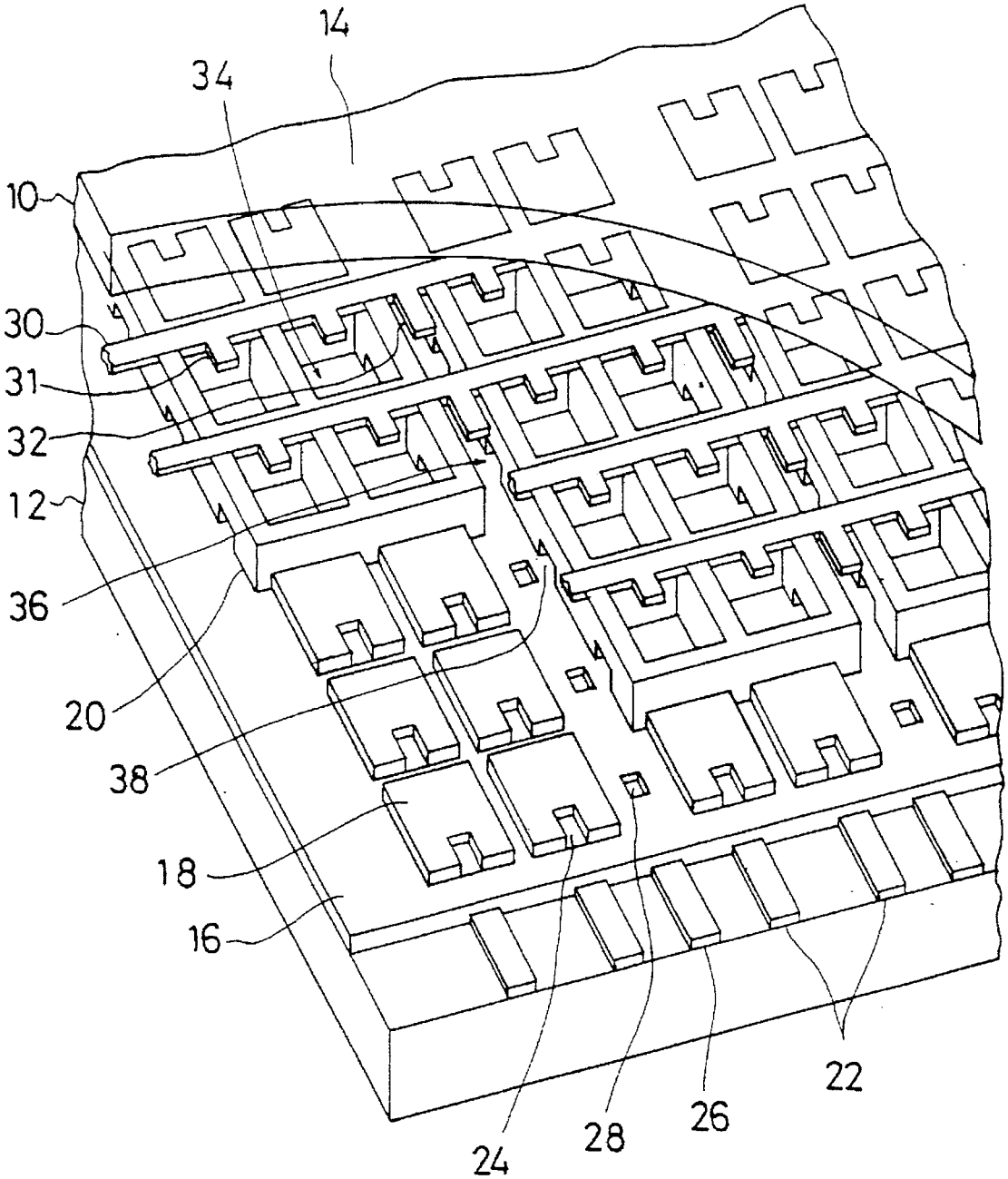
FIG.7 PRIOR ART
FIG. 7 is a fragmentary perspective view showing a first conventional gaseous discharge display.
Figure 8:
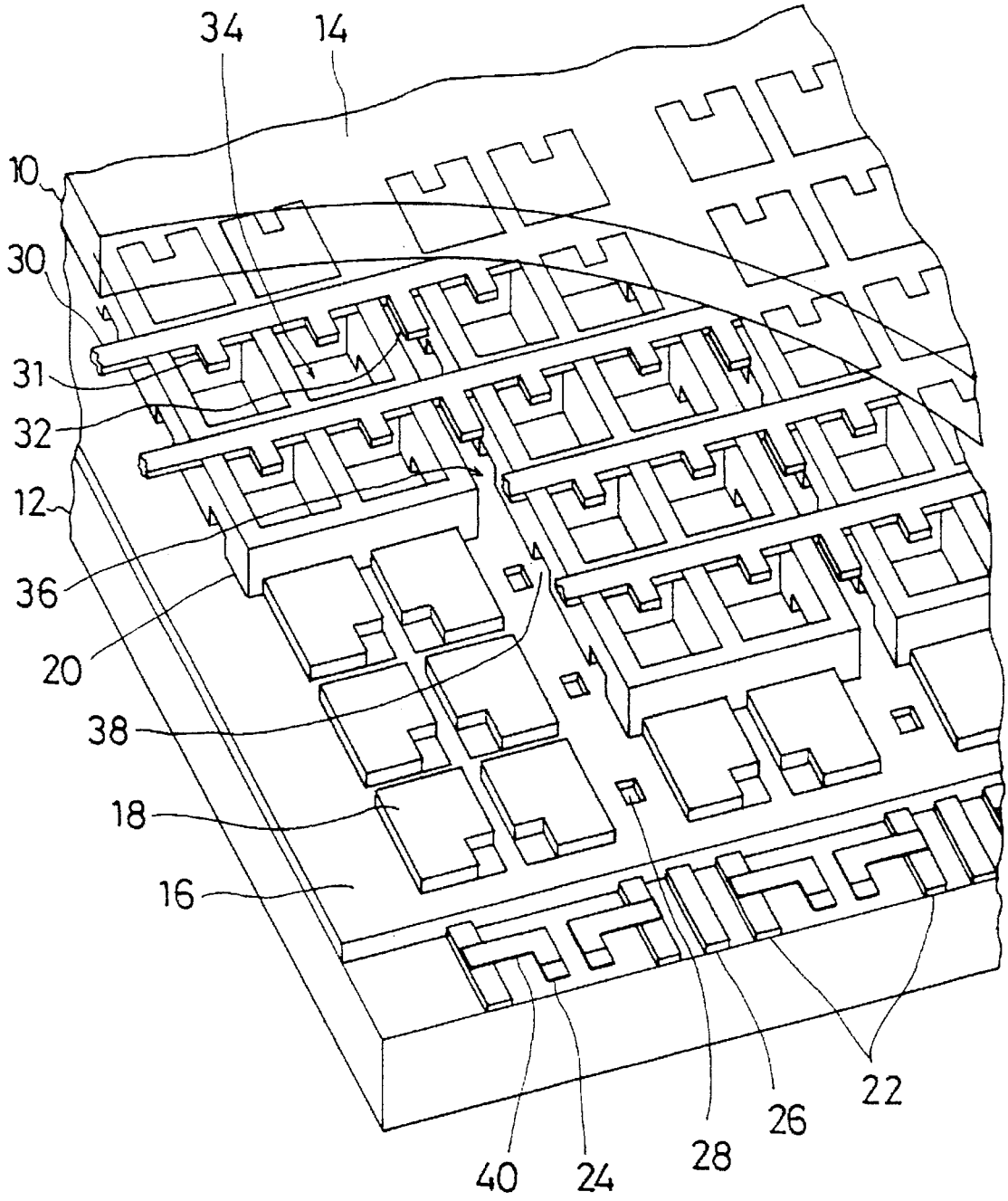
FIG.8 PRIOR ART
FIG. 8 is a fragmentary perspective view showing a second conventional gaseous discharge display.

The structure of the display panel is not limited to the one disclosed in FIG. 7 or FIG. 8. The present invention can be applied to any display panel equipped with the auxiliary discharge mechanism.

A preferable resistance value R of the auxiliary anode resistance 44 is somewhere between 100 KΩ and 5 MΩ. When the resistance value R is R=1 MΩ, the discharge current is given by $(V_{SA1}-C_{K2}-V_S)/R$=90 V/1 MΩ=90 μA.

The cathode material is a well-known one, such as Al, Ni, $BaAl_4$, $LaB_6$, and various perovskite cathode materials.

The filling gas is also a well-known one, such as He-Xe group, Ne-Xe group, or their mixture with He, Kr, At, etc. To extend the life of the apparatus, it would be preferable to maintain the pressure of the filling gas higher than 200 Torr for the He-Xe group gas, and higher than 100 Torr for the Ne-Xe group gas.

Figure 5:
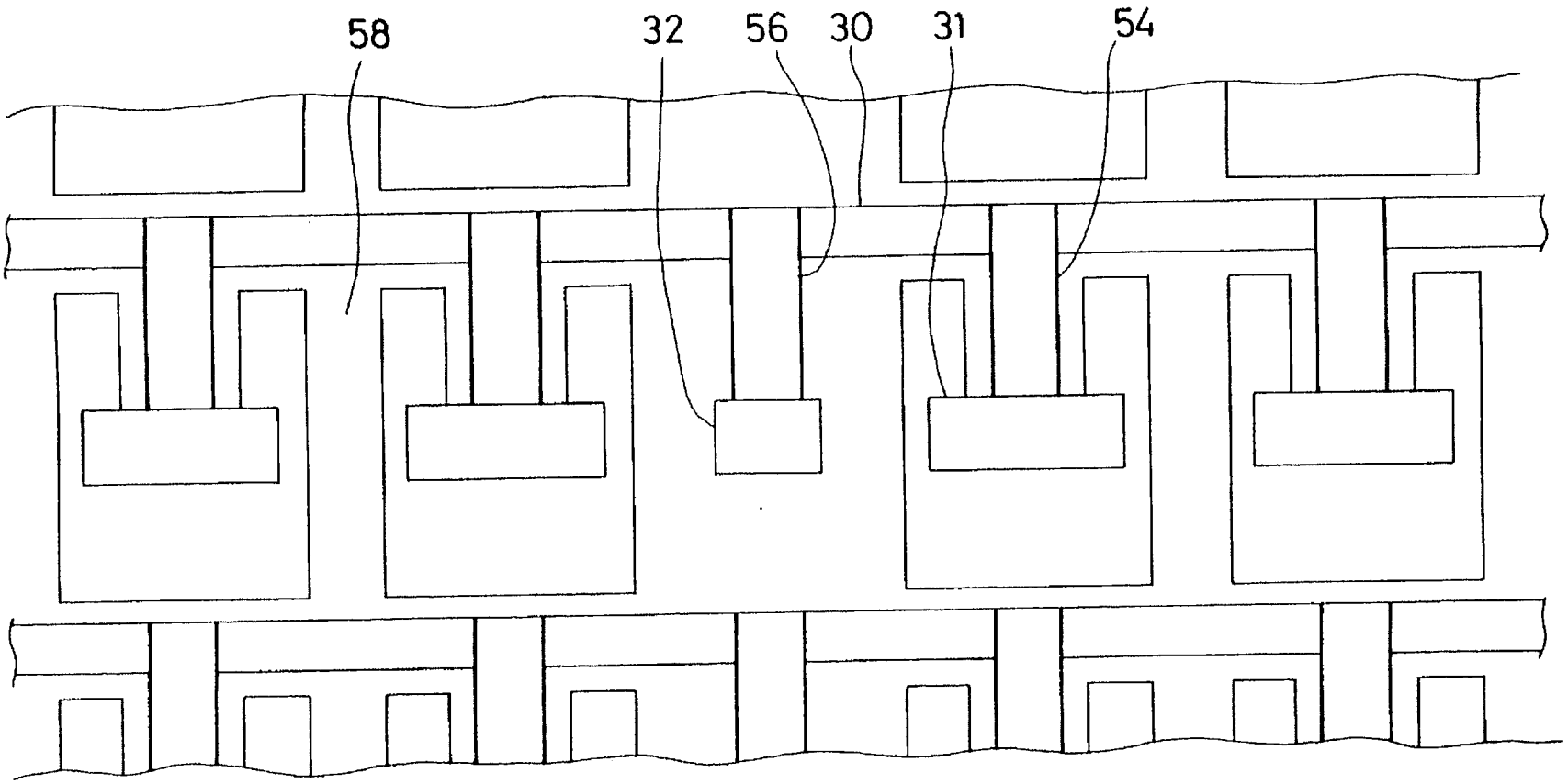
FIG. 5 is a plane view showing details of the cathode side of a gaseous discharge display in accordance with a second modification of the above one embodiment of the present invention.
Figure 6:
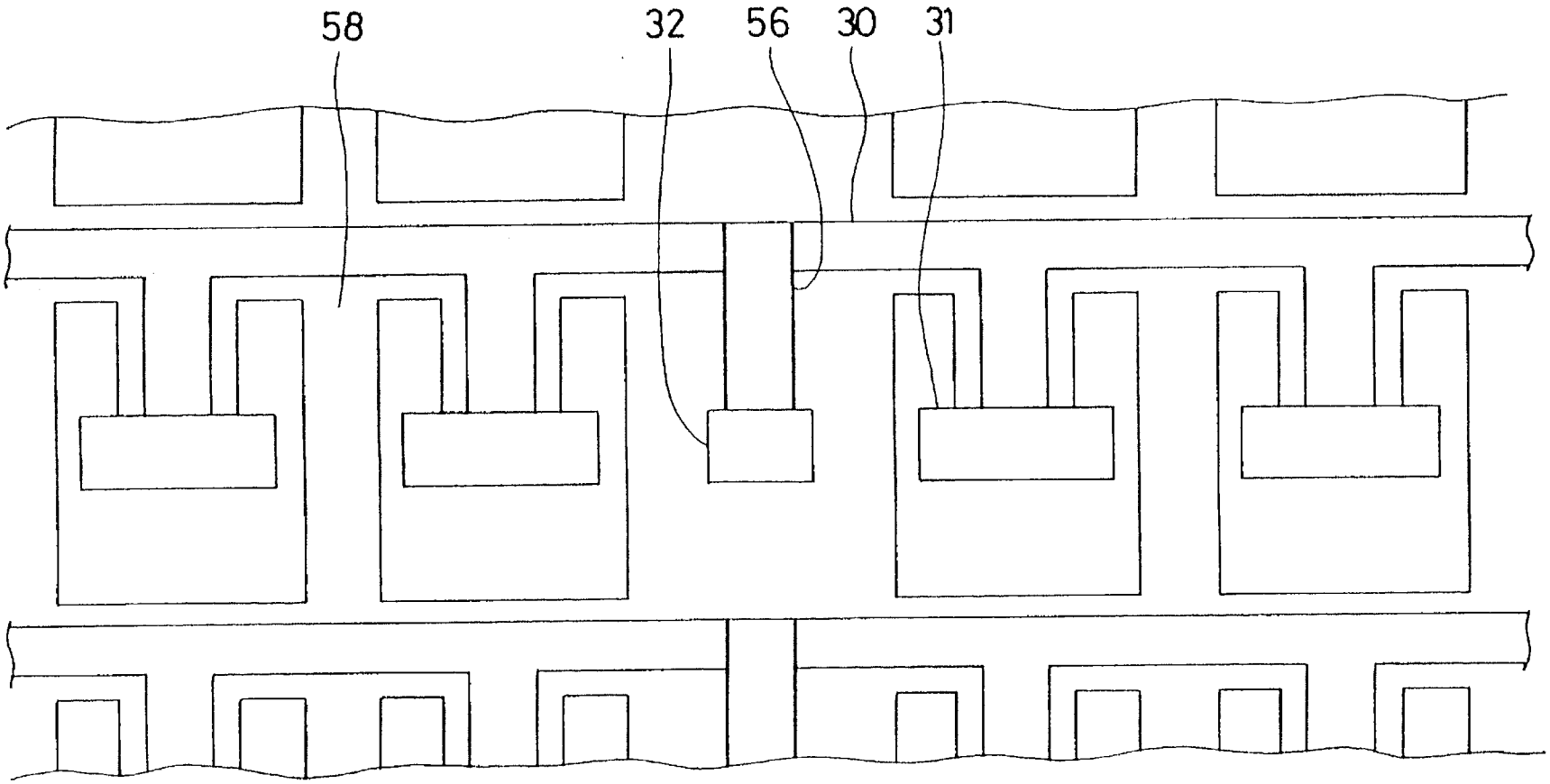
FIG. 6 is a plane view showing details of the cathode side of a gaseous discharge display in accordance with a third modification of the above one embodiment of the present invention.

Although, each of the display anode resistances 40 and the auxiliary anode resistances 44 is provided at the anode side in the above embodiment, such an arrangement can be replaced by the structure shown in FIG. 5 or FIG. 6. According to the structure of FIG. 5, the cathode bus bar 30 is formed on the front plate, and the cathode bus bar 30 is connected with each display cathode 31 via a display cathode resistance 54. The cathode bus bar 30 is also connected with each auxiliary cathode 32 via an auxiliary cathode resistance 56. The portion other than the display cathode 31 and the auxiliary cathode 32 is covered by the insulating layer 58. According to the structure of FIG. 6, the cathode bus bar 30 is formed on the front plate, and the cathode bus bar 30 is connected with each auxiliary cathode 32 via the auxiliary cathode resistance 56. The portion other than the display cathode 31 and the auxiliary cathode 32 is covered by the insulating layer 58. In this structure, the display cell resistance is connected to the rear plate side, i.e. to the display anode.

Manufacturing methods, materials, and driving methods of the cathode bus bar 30, the display cathode 31, the auxiliary cathode 32, the display cathode resistance 54 and the auxiliary cathode resistance 56 are similar to those of the above embodiment.

Although not shown in FIG. 1, another cathode (i.e. a reset electrode) is generally provided on the upper side of the first cathode ($C_1$ in FIG. 1) to cause a priming discharge for stably generate a series of auxiliary discharges. It is needless to say that an auxiliary cell resistance is provided at this portion.

In the above embodiments, the row electrodes are assigned to be anode while the column electrodes (i.e. the scan electrodes) are assigned to be cathode. However, it is also preferable that the row electrodes are cathodes and the column electrodes are anodes.

As this invention may be embodied in several forms without departing from the spirit of essential characteristics thereof, the present embodiments as described are therefore intended to be only illustrative and not restrictive, since the scope of the invention is defined by the appended claims rather than by the description preceding them, and all changes that fall within the metes and bounds of the claims, or equivalents of such metes and bounds, are therefore intended to be embraced by the claims.

What is claimed is:

1. A gaseous discharge display comprising:

a plurality of display cells for causing display discharge;

a plurality of auxiliary cells, each of said plurality of auxiliary cells corresponding to at least one of said plurality of display cells, each of said auxiliary cells operative for causing a priming discharge for the display discharge of the corresponding display cell; and a plurality of auxiliary cell resistances, each of said plurality of auxiliary cell resistances coupled in series to only one of said auxiliary cells, wherein each auxiliary cell has an auxiliary cell resistance coupled thereto.

2. The gaseous discharge display in accordance with claim 1, further comprises a plurality of display cell resistances, each being connected in series with a corresponding one of said display cells.

3. The gaseous discharge display in accordance with claim 1, wherein each of said display cells is driven by memory mode.

4. The gaseous discharge display in accordance with claim 1, wherein said plural display cells and said plural auxiliary cells are filled with noble gas including more than 5% Xe or Kr at a pressure not less than 200 Torr.

* * * * *